US005735239A

United States Patent [19]

Sugano et al.

[11] Patent Number: 5,735,239

[45] Date of Patent: Apr. 7, 1998

[54] CAMSHAFT ARRANGEMENT FOR DOHC ENGINE

[75] Inventors: Tomohiro Sugano; Yukihiro Kawashima; Hiroshi Yajima; Hideki Kubo, all of Fujisawa, Japan

[73] Assignee: Isuzu Motors Limited, Tokyo, Japan

[21] Appl. No.: 635,181

[22] Filed: Apr. 25, 1996

[30] Foreign Application Priority Data

Apr. 28, 1995 [JP] Japan ..... 7-106049

[51] Int. Cl.[6] ..... F01L 1/02

[52] U.S. Cl. ..... 123/90.31; 123/90.27

[58] Field of Search ..... 123/90.27, 90.31, 123/54.4, 54.5, 54.6, 54.7, 54.8

[56] References Cited

U.S. PATENT DOCUMENTS

| | | | |
|---|---|---|---|
| 4,553,473 | 11/1985 | Ichida et al. | 123/90.27 |
| 4,658,769 | 4/1987 | Horio et al. | 123/90.31 |
| 4,674,452 | 6/1987 | Asanomi | 123/90.31 |
| 4,915,066 | 4/1990 | Koshimoto et al. | 123/90.31 |
| 4,951,616 | 8/1990 | Aruga et al. | 123/90.31 |
| 4,957,077 | 9/1990 | Okitsu et al. | 123/90.31 |
| 4,966,106 | 10/1990 | Aruga et al. | 123/90.31 |
| 5,010,859 | 4/1991 | Ogami et al. | 123/90.31 |
| 5,033,421 | 7/1991 | Shimada et al. | 123/90.31 |
| 5,216,989 | 6/1993 | Iwata et al. | 123/90.31 |
| 5,386,808 | 2/1995 | Koch | 123/90.31 |

*Primary Examiner*—Weilun Lo

*Attorney, Agent, or Firm*—Rader, Fishman & Grauer PLLC

[57] ABSTRACT

A V-type DOHC engine including a crankshaft, right and left cylinder heads, three cylinders formed for each cylinder head, two intake and exhaust valves for each cylinder, first and second camshafts for the right cylinder head, third and fourth camshafts for the left cylinder head, and a power transfer mechanism for transmitting a drive power of the crankshaft to the first to fourth camshafts such that the camshafts rotate in the same direction. The power transfer mechanism has an intermediate shaft through which the drive power of the crankshaft is transmitted. A first space having dimensions sufficient to house that part of the power transfer mechanism which extends in the left cylinder head is formed at the front end of the left cylinder head and the rear end of the right cylinder head. A second space having dimensions sufficient to house that part of the power transfer mechanism which extends in the right cylinder head is formed at the front end of the right cylinder head and the rear end of the left cylinder head. Upon manufacturing, the right and left cylinder heads have the same configuration and the camshafts have the same configuration so that the production cost and efficiency are considerably reduced and improved. The right and left cylinder heads are 180-degree turned relative to each other when assembled in the engine.

5 Claims, 3 Drawing Sheets

CAMSHAFT ARRANGEMENT FOR DOHC ENGINE

BACKGROUND OF THE INVENTION

1. Technical Field

The present invention relates to a DOHC engine and particularly to a camshaft arrangement for V-shaped or horizontally opposed DOHC engine.

2. Background Art

One example of prior camshaft arrangements for DOHC engines is schematically illustrated in FIGS. 3A and 3B of the accompanying drawings. Referring to FIG. 3A which depicts a schematic and partial front view of a DOHC engine and FIG. 3B which depicts part of a plan view of the engine parts shown in FIG. 3A, a crankshaft 1 has its pulley 3 mounted at its front end, one camshaft 2 is provided above the crankshaft 1 on an air inlet side and has an associated pulley 4 at its front end, and the crankshaft 1 is drivingly coupled with the camshaft 2 by a toothed belt or chain 5 engaged over the pulleys 3 and 4. The camshaft 2 also has a gear 6 behind the pulley 4, as best illustrated in FIG. 3B. This gear 6 engages with a gear 7 provided at the front end of the other camshaft 8. These camshafts 2 and 8 extend parallel to each other. Therefore, rotation of the crankshaft 1 is transferred to the camshaft 2 and in turn to the camshaft 8. A chain may be used to drive the camshafts 2 and 8 instead of the gears 6 and 7. Generally the diameter of the pulley 4 is twice that of the crankshaft pulley 3 to reduce the rotational speed during the power transfer to the camshaft from the crankshaft 1. Numeral 10 designates a tension pulley to apply a predetermined tension to the toothed belt 5.

Since the camshaft 2 has the pulley 4 but the other camshaft 8 does not, these camshafts 2 and 8 have different configurations and they should be manufactured separately.

Another type of conventional DOHC engine is illustrated in FIG. 4 of the accompanying drawings. Referring to FIG. 4 which schematically shows a fragmentary sectional view of an engine, a distance L between camshafts 2 and 8 is relatively large (larger than a diameter D of a pulley 4) so that both of the camshafts 2 and 8 can have own pulleys 4 and 4. Accordingly, the camshafts 2 and 8 can be manufactured by same machines or dies. In addition, the first pulley 4 of the first camshaft 2 is coupled with a pulley of a crankshaft (not shown) by a first chain (not shown) and the second pulley 4 of the second camshaft 8 is also coupled with the pulley of the crankshaft by a second chain (not shown) so that the camshaft 2 is directly driven by the crankshaft and the other camshaft 8 is also directly driven by the crankshaft. Numeral 9 designates an intake port.

Recently, another type of engine was developed which has an intake port extending in a direction close to the vertical in order to acquire a higher engine output. This upright intake port arrangement, however, narrows an inter-valve angle and in turn reduces the distance L between the camshafts 2 and 8 as indicated by the phantom line (two-dot line) in FIG. 4. As a result, the two pulleys 4 approach each other so that both of the camshafts 2 and 8 cannot have associated pulleys. This is because the pulley 4 should have a relatively large diameter. Thus, the camshafts 2 and 8 should be manufactured separately like the arrangement shown in FIGS. 8A and 8B. Particularly a V-shaped or horizontal opposed DOHC engine requires four kinds of camshaft. In addition, cylinder heads should also be designed in conformity with such camshafts: the cylinder heads on right and left banks of the V-type or horizontally opposed-type engine should have different shapes. This significantly deteriorates productivity of engine parts and raises a manufacturing cost.

Another prior camshaft arrangement is shown in Japanese Patent Application, Publication No. 61-232805.

SUMMARY OF THE INVENTION

An object of the present invention is to provide a DOHC engine which has a plurality of camshafts but requires only one kind of camshaft and which has a plurality of cylinder heads but requires one kind of cylinder head.

Another object of this invention is to provide a DOHC engine which can be manufactured inexpensively while achieving a higher engine output.

According to one aspect of the present invention, there is provided a DOHC engine including: a plurality of cylinder heads having the same configuration, space being defined in front and rear end portions of each cylinder head respectively, at least one cylinder being formed for each cylinder head; two camshafts for activation of intake and exhaust valves for each cylinder head, all the camshafts having the same configuration; means for driving the camshafts in the same direction, the camshaft driving means being provided for each cylinder head; a crankshaft; and a power transfer mechanism extending to the camshaft driving means from the crankshaft for driving the camshaft driving means. All the cylinder heads have the same shape so that they can be manufactured by the same machine and die. Likewise, all the camshafts have the same shape so that they can be manufactured by the same machine and die.

The engine may include first and second cylinder heads, the camshaft driving means may include first and second intermediate shafts, the first intermediate shaft may extend outwardly from the first cylinder head, the second intermediate shaft may extend outwardly from the second cylinder head, the power transfer mechanism may include a first pulley mounted on the first intermediate shaft, a second pulley mounted on the second intermediate shaft, a third pulley mounted on the crankshaft and toothed belt means engaged over the first, second and third pulleys. The first and second cylinder heads have the same configuration when manufactured but they may be arranged in a 180-degree turned relationship when assembled in the engine. The engine may be a V-type engine.

These and other objects and advantages of the camshaft arrangement for a DOHC engine of the present invention will become more apparent as the following detailed description and the appended claims are read and understood with reference to the accompanying drawings.

BRIEF DESCRIPTION OF THE ACCOMPANYING DRAWINGS

Figure 3A:
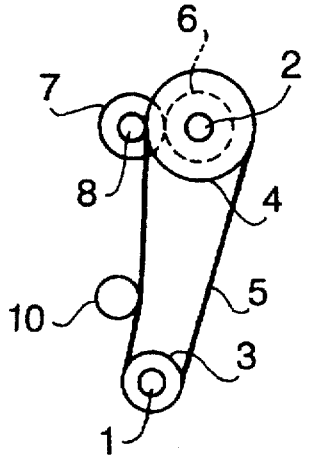
FIG. 3A PRIOR ART
Figure 3B:
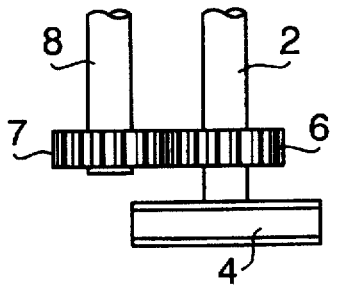
FIG. 3B PRIOR ART

FIG. 3A schematically illustrates a conventional DOHC engine;

FIG. 3B is a fragmentary top view of the engine shown in FIG. 3A; and

Figure 4:
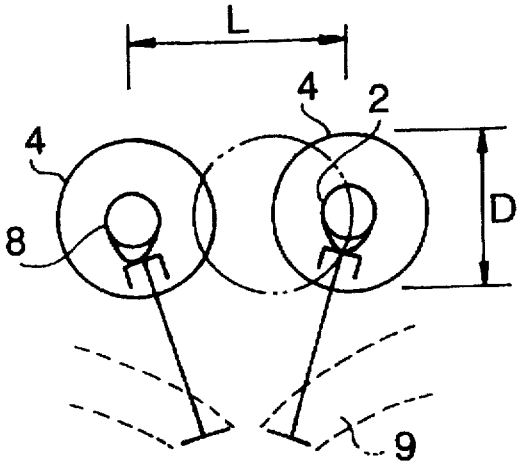
FIG. 4 PRIOR ART

FIG. 4 depicts a fragmentary view of another conventional engine.

DETAILED DESCRIPTION OF THE PREFERRED EMBODIMENTS

Now, a preferred embodiment of the present invention will be described in reference to FIGS. 1 and 2 of the accompanying drawings.

Figure 2:
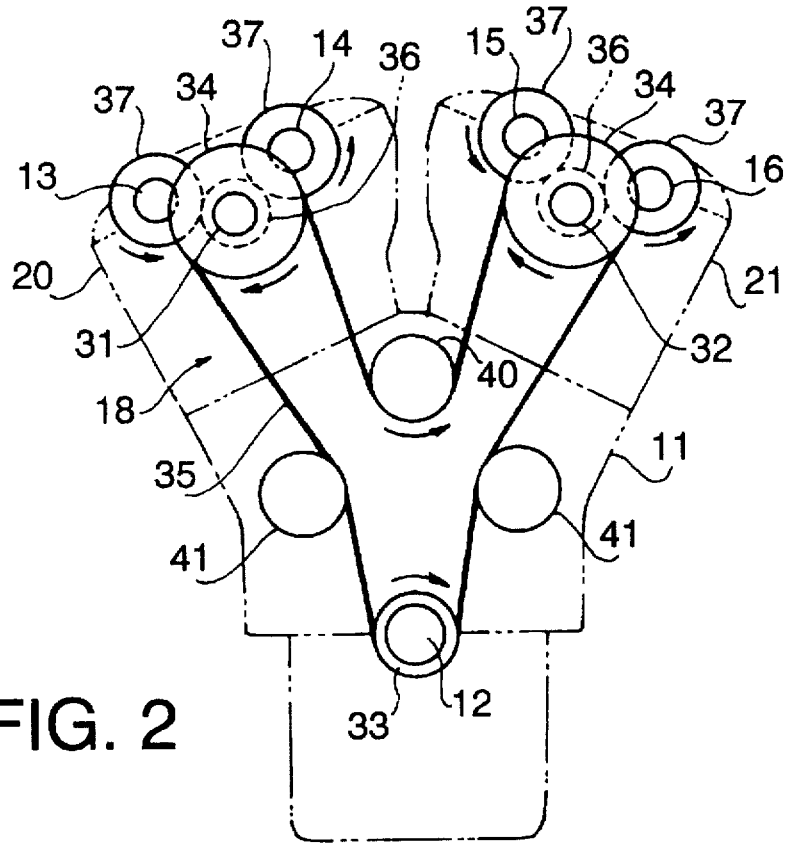
FIG. 2 is a schematic front view of the engine shown in FIG. 1.

Referring first to FIG. 2, a DOHC engine of this embodiment is a V-type engine having six cylinders (three cylinders on each side). Numeral 11 designates a cylinder block. The six cylinders are all formed in the cylinder block 11 and extend in inclined directions relative to the vertical axis.

Figure 1:
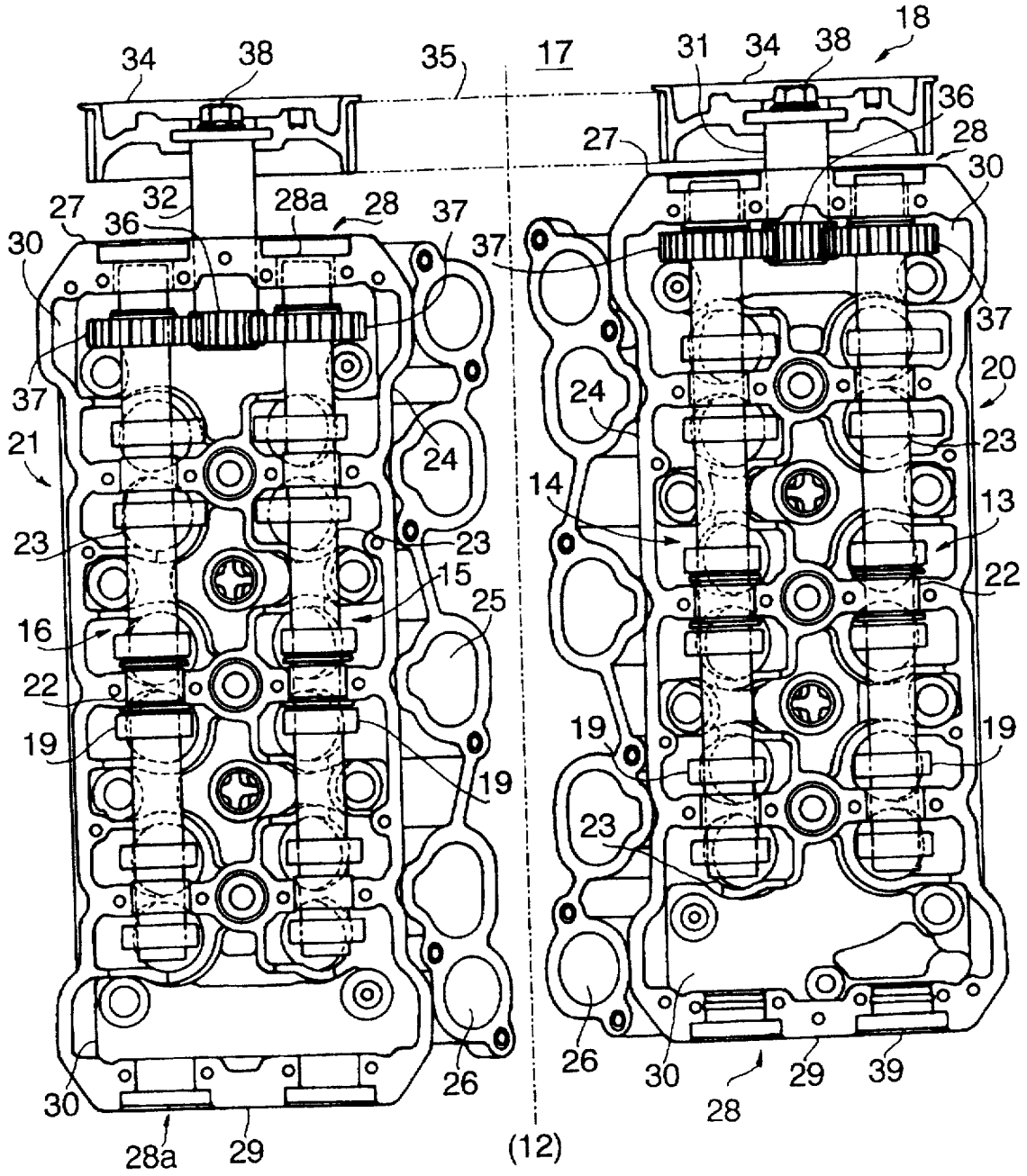
FIG. 1 illustrates a plan view of a V-type DOHC engine according to the present invention without covers of cylinder heads.

Referring to FIG. 1, right and left banks of the cylinder block or the engine are offset relative to each other in the longitudinal direction of the crankshaft 12 in a plan view. Each cylinder has two intake ports and associated intake valves as well as two exhaust ports and associated exhaust valves. The intake and exhaust valves of this engine are opened and closed by camshafts 13, 14, 15 and 16 respectively. The camshafts 13–16 are positioned above the valves and extend in parallel to each other in the longitudinal direction of the crankshaft 12 or the engine. The camshafts 13–16 are driven by the crankshaft 12 as a drive power is transmitted to the camshafts 13–16 from the crankshaft 12 via a power transfer mechanism 18. The power transfer mechanism 18 is provided at the front end 17 of the engine (upper end in the illustration).

Each of the camshafts 13–16 has a plurality of cams 19 formed thereon at predetermined distances in a longitudinal direction of the camshaft. Each cam 19 is a prescribed profile: it is configured to appropriately engage with a head of the associated valve. The camshafts 13 and 14 are supported on an upper surface of a right cylinder head 20 by cam brackets 22 and other parts and the camshafts 15 and 16 are supported on an upper surface of a left cylinder head 21 by cam brackets 22 and other parts. In the cylinder heads 20 and 21, formed are through holes 23 to receive valve stems of the intake and exhaust valves. Intake ports 25 extend from an inner lateral wall of each cylinder head 20/21 toward the center line of the engine (single dot line) at substantially right angles. Cooling water passages 26 also extend from the inner side wall of each cylinder head toward the center line of the engine. A front end of each of the camshafts 13–16 terminates at the front end 27 of the associated cylinder head 20/21 and is received in and supported by a shaft receiving recess 28*a* of a bracket 28 provided at the front end 27 of the cylinder head 20/21. Two brackets 28 are provided at the front end of each cylinder head 20/21 in the illustrated embodiment. The same brackets 28 are also provided at the rear end 29 of each cylinder head 20/21. In this embodiment, however, the rear brackets 28 are not used to support the rear ends of the camshafts 13–16 and their recesses 28*a* are closed by plugs 39.

Space 30 is defined just inside of the front end 27 and rear end 29 of each cylinder head 20/21 to receive part of the power transfer mechanism 18.

The power transfer mechanism 18 includes a first intermediate shaft 31 rotatably supported at the front end 27 of the right cylinder head 20, a first pulley 34 mounted on the first intermediate shaft 31 at its front end, a second intermediate shaft 32 rotatably supported at the front end 27 the left cylinder head 21, a second pulley 34 on the left intermediate shaft 32 at its front end, a third pulley 33 (FIG. 2) mounted on the crankshaft 12 at its front end, a guide pulley 40 mounted on a front face of the cylinder block 11 above the crankshaft 12, and a toothed belt 35 engaged over the first, second and third pulleys 34, 34 and 33 as well as the guide pulley 40 to drivingly couple the intermediate shafts 31 and 32 with the crankshaft 12. Right and left tension pulleys 41 and 41 are also provided on the front face of the cylinder block 11 above the crankshaft 12 and below the guide pulley 40 to contact the toothed belt 35 such that they can apply an appropriate tension to the toothed belt 35. The intermediate shafts 31 and 32 have gears 36 and 36 mounted thereon at their rear ends respectively. These gears 36 and 36 are engaged with gears 37, 37, 37 and 37 of the camshafts 13–16 respectively. As understood from FIG. 2, therefore, rotation of the crankshaft 12 is transmitted to the camshafts 13–16 and in turn to the intake and exhaust valves on the right and left banks of the cylinder block 11 via the toothed belt 35, the pulleys 33 and 34, the intermediate shafts 31 and 32 and the gears 36 and 37. The intermediate shaft 31 is located between and below a right pair of camshafts 13 and 14 and the other intermediate shaft 32 is located between and below a left pair of camshafts 15 and 16 as illustrated in FIG. 2. The guide pulley 40 is provided to determine the looping route of the toothed belt 35 and/or determine how deep the belt 35 engages with the pulleys 34.

Referring back to FIG. 1, the front end of the intermediate shaft 31/32 extends forward beyond the front end 27/27 of the cylinder head 20/21 and the pulley 34 is mounted thereon by a bolt 38/38. The lengths of the intermediate shafts 31 and 32 are determined such that the right and left pulleys 34 and 34 as well as the pulley 33 of the crankshaft 12 are positioned in the same plane. Since the cylinder heads 20 and 21 are offset relative to each other in the longitudinal direction of the engine (single dot line), the length of the intermediate shaft 31 is different from that of the intermediate shaft 32 in this embodiment. As illustrated, the left shaft 32 is longer than the right shaft 31. The rear end of each intermediate shaft 31/32 extends in the space 30 and the gear 36 is mounted thereon. The gear 37 is mounted on the front end of each of the camshafts 13–18. Two of the gears 37 mesh with the gear 36 of the right intermediate shaft 31 and other two gears 37 mesh with the gear 36 of the left intermediate shaft 32. In this manner, the gears 36, 37 and 37, which are part of the power transfer mechanism 18, are housed in the front space 30 of each cylinder head 20/21. The rear space 30 of each cylinder head is not used to house gears in this embodiment. All the camshafts 13–16 are rotated in the same direction (counterclockwise direction in this embodiment as indicated by the arrows in FIG. 2).

As understood from the above, the camshafts 13–16 are rotated by the crankshaft 12 by way of the power transfer mechanism 18, and the intake and exhaust valves are lifted and lowered in accordance with the profiles of the cams 19 upon rotation of the camshafts 13–16. Since the camshafts 13–16 rotate in the same direction, it can be designed that combustion takes place in the six cylinders in the order of first to sixth cylinders from the front by appropriately determining phase differences between the respective cams 19. In the illustrated embodiment, specifically, it can be designed that the combustion occurs first in the front cylinder of the right cylinder head 20, then in the front cylinder of the left cylinder head 21, in the middle cylinder of the right cylinder head, in the middle cylinder of the left cylinder head, in the rear cylinder of the right cylinder head and in the rear cylinder of the left cylinder head. This is the typical combustion order of the V-type engine.

Further, the four camshafts 13–16 can have the same configuration including the shape of the front end for mounting of the gears 37. In other words, same machines and dies are required to manufacture the camshafts 13–16.

In addition, since the cylinder heads 20 and 21 have the common space 30 at the front and rear ends respectively, they have the same shapes at the time of manufacturing: the left cylinder head 21 can be used as the right cylinder head 20 by turning the cylinder head 21 180 degrees at the time of assembling into the engine. In this case, the rear space 30 of the cylinder head 21 will be used to receive the gears 36 and 37. It should be noted that upon turning the left cylinder head 21 by 180 degrees, the intake ports 25 and the cooling fluid passages 16 of the cylinder head 21 will be directed inward (left in FIG. 1) toward the center line (single dot line) at right angles like the cylinder head 20 will do. Thus, it can be used as the right cylinder head perfectly. Accordingly, same machines and dies are required to manufacture the right and left cylinder heads 20 and 21.

In sum, the camshafts and cylinder heads are produced using a minimum number of machines so that the manufacturing cost is considerably reduced and the production efficiency is greatly improved.

It should be noted that the present invention is not limited to the illustrated embodiment. For example, although the intermediate shafts 31 and 32 are connected with the camshafts 13–16 by the gears 36 and 37, any suitable mechanism may be employed as long as it can cause the camshafts 13–16 to rotate in the same direction: a chain-sprocket mechanism may be utilized for this purpose. Further, the guide pulley 40 and tension pulleys 41 may be omitted if the engine operates satisfactorily, and only one intake valve and only one exhaust valve may be provided for each cylinder. Only one intake and exhaust valves may be provided for each cylinder and only one camshaft may be provided for each cylinder head.

In FIG. 1, the upper right space 30 should be identical to the lower left space 30 and the upper left space 30 should be identical to the lower right space 30 in shape, but the upper right space 30 may be different from the upper left space 30 and the lower right space 30 may be different from the lower left space 30.

Teaching of the present invention is applicable to a horizontally opposed engine having an inter-bank angle of 180 degrees.

What is claimed is:

1. A dual overhead camshaft (DOHC) engine comprising:

a plurality of cylinder heads having the same configuration, each cylinder head having front and rear end portions, space being defined in the front and rear end portions of each cylinder head, at least one cylinder being formed for each cylinder head;

two camshafts for each cylinder head for activation of intake and exhaust valves for each cylinder head, the camshafts having the same configuration;

means for driving the camshafts in the same direction, the camshaft driving means being provided for each cylinder head;

a crankshaft;

a power transfer mechanism extending to the camshaft driving means from the crankshaft for driving the camshaft driving means, wherein each cylinder head includes a respectively associated intermediate shaft, wherein each intermediate shaft includes first and second ends and at least one of said first and second ends of each intermediate shaft projects out of its respectively associated cylinder head and the remaining end of each intermediate shaft projects in the space of the associated cylinder head, wherein each intermediate shaft is coupled to said crankshaft by a first transmission means located outside of the cylinder heads, wherein each intermediate shaft of each head is coupled to the two camshafts respectively associated with the same head by way of a second transmission means residing in the space of the associated cylinder head.

2. The DOHC engine of claim 1, wherein there are provided first and second cylinder heads, the camshaft driving means includes first and second intermediate shafts, the first intermediate shaft extends outwardly from the first cylinder head, the second intermediate shaft extends outwardly from the second cylinder head, the power transfer mechanism includes a first pulley mounted on the first intermediate shaft, a second pulley mounted on the second intermediate shaft, a third pulley mounted on the crankshaft and toothed belt means engaged over the first, second and third pulleys.

3. The DOHC engine of claim 2, wherein the first and second intermediate shafts have lengths such that the first, second and third pulleys are positioned in a single plane.

4. The DOHC engine of claim 1, wherein two intake valves and two exhaust valves are provided for each cylinder.

5. The DOHC engine of claim 1, wherein the engine is a V-type engine which has six cylinders, three in each cylinder head.

* * * * *